United States Patent [19]

Smith et al.

[11] Patent Number: 4,877,461

[45] Date of Patent: Oct. 31, 1989

[54] NICKEL-BASE ALLOY

[75] Inventors: Gaylord D. Smith; Curtis S. Tassen; Pasupathy Ganesan, all of Huntington; Jack M. Wheeler, Lesage, all of W. Va.

[73] Assignee: Inco Alloys International, Inc., Huntington, W. Va.

[21] Appl. No.: 242,732

[22] Filed: Sep. 9, 1988

[51] Int. Cl.[4] ..... C22F 1/10

[52] U.S. Cl. ..... 148/11.5 N; 148/12.7 N; 148/410; 148/428

[58] Field of Search ..... 148/11.5 N, 12.7 N, 148/410, 428; 420/445, 446, 449, 450

[56] References Cited

U.S. PATENT DOCUMENTS 3,859,060 1/1975 Eiselstein et al. ..... 420/445
4,474,733 10/1984 Susikida et al. ..... 420/443

OTHER PUBLICATIONS

"Microstructure & Phase Stability of Inconel 617", Mankins, Hoiser & Bassford, Metallurgical Transactions, V5, Dec. 1974, 2579–2590.

"Analysis of Precipitated Phase in Heat Treated Inconel Alloy 617", Takahashi T., Fujiwara J., Matsushima T., et al., Trans. Iron and Steel Inst. of Japan, V.18, #221, 1978, 221–224.

"Structure/Property Relationships in Solid—Solution Strengthened Superalloys", Klarstrom D. L., Tawancy M. F., Rothman M. F., Proc. Conf. Superalloys 1984, AIME, 1984, 553–562.

"Creep Properties of Inconel 617 under and Helium at 800° to 1000° C.", Cook R. H., Nuclear Technology, V. 66, Aug. 1984, 283–288.

"Development of a Ni—Base Resistance Alloy (TOMILLOY) for Gas Turbine Combuster", I. Tsuji, H. Ito, K. Tsukagoshi et al., (Mitsubishi Heavy Industries, Ltd.), N.T.I.S. PB83—215889, 1983, pp. 1–23.

*Primary Examiner*—R. Dean
*Attorney, Agent, or Firm*—Raymond J. Kenny

[57] ABSTRACT

The stress-rupture strength of a nickel-chromium-molybdenum-cobalt alloy is enhanced by reason of a special morphological microstructure which in terms of carbides present is characterized by a predominant amount of the $M_6C$ carbide.

16 Claims, No Drawings

NICKEL-BASE ALLOY

The subject invention is directed to nickel-chromium alloys, and more particularly to nickel-chromium-molybdenum-cobalt alloys characterized by a special carbide morphological microstructure which imparts to the alloys enhanced stress-rupture strength at elevated temperatures.

BACKGROUND

As those skilled in the art are aware, since the 1940–50's era, the search has been continuous in the quest for new alloys capable of withstanding increasingly severe operating conditions, notably temperature and stress, brought about by, inter alia, advanced designs. This has been evident, for example, in respect of gas turbine engine components such as combustors. Alloys of this type must be fabricable since they are often produced in complex shapes. But what is required apart from fabricability is a combination of properties, including good stress rupture life at high temperatures, 1600°–2000° F. (871°–1093° C.), low cycle fatigue, ductility, structural stability, high temperature corrosion resistance, and weldability.

In significant measure, alloys currently used for such applications are those of the solid-solution type in which there is substantial carbide hardening/strengthening but not much by way of precipitation hardening of, say, the $Ni_3(Al, Ti)$ type (commonly referred to as gamma prime hardening). In the latter type the gamma prime precipitate tends to go back into solution circa 1700°–1750° F. (927°–954° C.) and thus is not available to impart strength at the higher temperatures. One of the most recognized and widely used solid-solution alloys is sold under the designation INCONEL ® alloy 617, an alloy nominally containing 22% Cr, 12.5% Co, 9% Mo, 1.2% Al, 1.5% Fe with minor amounts of carbon and usually titanium. This alloy satisfies ASME Code cases 1956 (Sections 1 and 8 non-nuclear construction of plate, pipe and tube to 1650° F.) and 1982 (Section 8 non-nuclear construction of pipe and tube to 1800° F.).

Notwithstanding the many attributes of Alloy 617, as currently produced it has a stress rupture life of less than 20 hours, usually about 10 to 15 hours, under a stress of 11,000 psi (75.85 Mpa) and at a temperature of 1700° F. (927° C.). What is required is a strength level above 20 hours under such conditions. This would permit of the opportunity (a) to reduce weight at constant temperature, or (b) increase temperature at constant weight, or (c) both. In all cases gas turbine efficiency would be enhanced, provided other above mentioned properties were not adversely affected to any appreciable extent.

Perhaps a conventional approach might suggest increasing the grain size of an alloy such as 617 since the larger grain sizes, ASTM #1–#2, lend to stress-rupture strength. Alternatively, one might posit using a higher alloying content e.g., molybdenum, to achieve greater strength. But these approaches, depending on end use, may be limited or unavailable. For combustor sheet there are specifications which require about 4 to 10 grains across the gauge to thus ensure satisfactory ductility and adequate low cycle fatigue. This in turn would mean that the average grain size should not be much beyond ASTM #4 or #3. On the other hand, excessively high percentages of such constituents as molybdenum and chromium (matrix stiffeners) can result in the formation of deleterious amounts of subversive morphological phases such as sigma. This lends to embrittlement, phase instability and weldability and fabrication problems.

SUMMARY OF THE INVENTION

We have found that the stress-rupture strength of nickel-chromium-molybdenum alloys, particularly Alloy 617, can be improved if the alloys are characterized by a special microstructure comprised predominantly of $M_6C$ carbides and to a lesser extent $M_{23}C_6$ carbides. It has been found that the $M_6C$ carbide, as will be discussed more fully infra, enhances stress-rupture strength to a greater extent than the $M_{23}C_6$ carbide. As will be apparent to those skilled in the art, the letter "M" in $M_6C$ denotes principally molybdenum and to a lesser extent chromium. In $M_{23}C_6$ "M" is representative principally of the chromium atom and to a lesser extent the molybdenum atom.

INVENTION EMBODIMENTS

Generally speaking and in accordance herewith the contemplated nickel-chromium-molybdenum alloys contain about 15 to 30% chromium, about 6 to 12% molybdenum, about 5 to 20% cobalt, about 0.5 to 1.5% aluminum, up to about 0.75% titanium, up to about 0.15% carbon, up to about 0.02% boron, up to about 0.5% zirconium and the balance essentially nickel. The alloy microstructure is essentially a solid-solution in which there is a distribution of $M_6C$ carbides in the grain boundaries and grains plus $M_{23}C_6$ carbides located in both the grains and grain boundaries. Of the carbides present, those of the $M_6C$ type constitute at least 50% and preferably 70% by weight. The $M_6C$ carbide should constitute at least 1 or 2% by weight or the total alloy. No particular advantage is gained should this carbide form much exceed about 2%. In fact, stress rupture properties are lowered due to the loss of molybdenum from solid solution strengthening. In the less demanding applications the $M_6C$ carbide can be as low as 0.5 or 0.75% by alloy weight. Further, it is preferred that the $M_6C$ carbide be not greater than about 3 microns in diameter, this for the purpose of contributing to creep and stress rupture life. Moreover, the alloy should be characterized by a recrystallized, equiaxed microstructure, preferably about ASTM #3 to ASTM #5, with the final grain size set by the degree of cold work and the annealing temperature. Microstructurally the grains are highly twinned with the $M_6C$ particles being discrete and rather rounded.

In addition to the morphology above described the alloy matrix will also contain a small volume fraction of titanium nitride (TiN) particles, usually less than 0.05%, in the instance where the alloy contains titanium and nitrogen. The TiN phase, as in the case of the $M_{23}C_6$ phase, does contricute somewhat to high temperature strength but not as importantly as $M_6C$. Gamma prime will normally be present in small quantities, usually less than 5%. If additional gamma prime strengthening is desired for moderate temperature applications, e.g., 1200°–1600° F. (649°–815° C.), the aluminum can be extended to 3% and the titanium to 5%.

In a most preferred embodiment the alloy contains about 19 to 25% chromium, about 7 to 11% molybdenum, about 7.5 or 10 to 15% cobalt, about 0.8 to 1.2% aluminum, up to about 0.6% titanium, about 0.04 or 0.06 to 0.12% carbon, up to about 0.01% boron and the balance essentially nickel.

Referring again to Alloy 617, since its inception (circa 15-20 years ago) it has been characterized by a microstructure predominantly of $M_{23}C_6$ carbides. A metallographic study was presented in 1974 by W. L. Mankins, J. C. Hosier and T. H. Bassford is a paper entitled "Microstructure and Phase Stability of INCONEL alloy 617" Metallurgical Transactions, Vol. 5, December 1974, pages 2579-2589. The authors did not conclusively find $M_6C$ but found a small volume fraction of gamme prime which imparted some degree of strength at 1200°-1400° F. (649°-760° C.). In a paper authored by Takahashi et al entitled, "Analysis of Precipitated Phase In Heat Treated INCONEL Alloy 617", Transactions ISIJ, Vol. 18 (1978), the authors concluded that while $M_{23}C_6$ was the predominant phase $M_6C$ was present together with some gamma prime ($Ni_3Al$). As far as we are aware, there was no recognition in either study (nor since then) of the desirability of forming a predominant $M_6C$ phase to enhance stress rupture strength.

In addition to the foregoing, we have also discovered that a special combination of cold working and thermal processing of nickel-chromium-molybdenum alloys is most effective in producing the above discussed microstructure. In this regard, the alloys should be cold worked at least 15% but not more than 60% due to work hardening considerations. The amount of cold work can be extended down to 10% but at a needless sacrifice in properties. It is advantageous that the degree of cold work be from 15 to less than 40% and most preferably from 15 to 30%. Intermediate annealing treatments may be employed, if desired, but the last cold reduction step should preferably be at least 15% of the original thickness.

The thermal processing operation should be conducted above the recrystallization temperature of the alloy and over the range of about 1850° to about 2125° F. (1010°-1163° C.) for a period at least sufficient (i) to permit of an average grain size of about ASTM #3 to about ASTM #5 to form and (ii) to precipitate the $M_6C$ carbides. A lesser amount of $M_{23}C_6$ carbides will also form together with any TiN (the TiN may already be present from the melting operation). The heat treatment (an annealing treatment) is time, temperature and section thickness dependent. For thin strip or sheet, say less than 0.025 inch in diameter, and a temperature of 1850° to 2100° F. (1010° to 1149° C.) the time may be as short as 1 or 2 minutes. The holding time need not exceed ¼ hour. For most wrought products a holding period of up to 15 or 20 minutes, say 3 to 5 minutes, is deemed satisfactory. Cold worked alloys exposed at temperatures much below 1850° F. (1010° C.) tend to form the $M_{23}C_6$ carbide virtually exclusively. If treated much above 2125° F. (1163° C.), the carbides formed during prior processing and heat-up virtually all dissolve. As a consequence, upon subsequent cooling virtually only $M_{23}C_6$ carbides will form even if held at the above temperature range for as long as two hours. A more satisfactory annealing temperature is from about 1875° to about 2025° F. (1024°-1107° C.) and a most preferred range is from 1900°-2000° F. (1093°-1149° C.).

In addition to the above, it might be added that the $M_6C$ and $M_{23}C_6$ carbides both vie and are competitive for the limited available carbon. The $M_6C$ forms in appreciable amounts when $M_{23}C_6$ has been resolutionized and $M_6C$ is still thermodynamically stable, a condition which exists above the recrystallization temperature and below about 2125° F. (1163° C.). Cold work is essential to trigger the desired microstructure. However, as will be shown, too much cold work can result in an excessive amount of precipitate with concomitant depletion of the solid solution strengtheners, molybdenum and chromium.

To give those skilled in the art a better appreciation of the invention the following information and data are given.

Commercial size heats, Alloys A, B, C, D and E, were prepared (corresponding to Alloy 617), chemistries being given in Table I, using vacuum induction melting and electroslag remelting.

TABLE I

| | WeightPercent | | | | | | | | | | |
|---|---|---|---|---|---|---|---|---|---|---|---|
| Alloy | C | Mn | Fe | Si | Cu | Ni | Cr | Al | Ti | Co | Mo |
| A | 0.06 | 0.06 | 0.20 | 0.16 | 0.05 | 53.09 | 22.18 | 1.15 | 0.28 | 12.63 | 9.14 |
| B | 0.06 | 0.06 | 2.14 | 0.16 | 0.14 | 52.19 | 22.02 | 1.28 | 0.28 | 12.54 | 9.13 |
| C | 0.06 | 0.06 | 2.93 | 0.16 | 0.06 | 53.17 | 21.32 | 1.08 | 0.36 | 12.08 | 8.77 |
| D | 0.06 | 0.03 | 0.86 | 0.08 | 0.03 | 54.23 | 21.91 | 1.17 | 0.19 | 12.55 | 8.89 |
| E | 0.06 | 0.06 | 0.68 | 0.11 | 0.05 | 54.06 | 21.78 | 1.20 | 0.30 | 12.74 | 8.70 |

Ingots were hot worked at about 2200° F. (1204° C.) to 3 inch thick slabs and then reduced to 0.3 inch thick hot band on a continuous hot reversing mill. The coil stock was then annealed at 2150° F. (1177° C.) for 3 to 5 minutes and cold reduced per the final reductions of Table II to test stock.

Alloy A was given cold roll reductions of 16.6%, 40% and 51.7% respectively, and then annealed as reflected in Table II. Final thicknesses are also reported in Table II. Alloys B, C, D and E were alo cold reduced and annealed as shown in Table II.

TABLEII

| Code | Percent Cold Reduction | Annealing Condition in Air Temp. °F.(°C.)/ Time (min.) | Final Gauge (mm) | Grain Size (ATSM No.) |
|---|---|---|---|---|
| A-1 | 40.0 | 2150 (1177)/15 | 4.77 | — |
| A-2 | 40.0 | 2150 (1177)/15 + 1900 (1038)/120 | 4.77 | — |
| A-3 | 40.0 | 2150 (1177)/15 + 2000 (1093)120 | 4.77 | — |
| A-4 | 40.0 | 2150 (1177)/15 + 1900 (1038)/120 + 1400 ( 760)/960 | 4.77 | — |
| A-5 | 40.0 | 2050 (1121)/ 5 | 3.16 | 2-3 |
| A-6 | 16.6 | 2150 (1177)/ 5 | 1.54 | — |
| A-7 | 51.7 | 2150 (1177)/ 5 | 1.54 | — |
| A-8 | 16.6 | 2200 (1204)/ 1 | 1.54 | 1-2 |
| A-9 | 51.7 | 2200 (1204)/ 1 | 1.54 | 2 |
| A-10 | 51.7 | 2000 (1093)/ 1 | 1.54 | ** |
| A-11 | 16.6 | 1900 (1038)/ 1 | 1.54 | 3-4 |
| A-12 | 16.7 | 2000 (1093)/ 1 | 1.54 | 3-4 |
| A-13 | 20.0 | 2100 (1149)/10 | 3.17 | 4-5 |
| B-1 | 56.0 | 2050 (1121)/ 5 | 0.63 | 4-5 |
| B-2 | 9.0 | 2150 (1177)/ 5 | 0.51 | 5 |
| C-1 | 59.4 | 1900 (1038)/ 1 | 0.65 | 7-8 |
| C-2 | 59.4 | 2000 (1093)/ 1 | 0.65 | 7-8 |
| C-3 | 59.4 | 2150 (1177)/ 5 | 0.65 | — |
| C-4 | 59.4 | 2200 (1204)/ 1 | 0.65 | 2-3 |
| D-1 | 40.0 | 2150 (1177)/ 5 | 1.58 | 2-3 |

TABLEII-continued

| Code | Percent Cold Reduction | Annealing Condition in Air Temp. °F.(°C.)/ Time (min.) | Final Gauge (mm) | Grain Size (ATSM No.) |
|---|---|---|---|---|
| D-2 | 20.0 | 2100 (1149)/ 5 | 4.77 | 4–5 |
| D-3 | 20.0 | 2100 (1149)/10 | 4.77 | 6 |
| D-4 | 20.0 | 2100 (1149)/15 | 4.77 | 3–4 |
| D-5 | 20.0 | 2125 (1163)/ 1 | 4.77 | 4 |
| D-6 | 20.0 | 2125 (1163)/ 5 | 4.77 | 4 |
| D-7 | 20.0 | 2125 (1163)/10 | 4.77 | 1–2 |
| D-8 | 20.0 | 2125 (1163)/15 | 4.77 | 1–2 |
| D-9 | 20.0 | 2125 (1163)/30 | 4.77 | 1 |
| E-1 | 40.0 | 2150 (1177)/ 5 | 2.25 | 3–4 |

**Did not recrystallize

Stress-rupture lives for the alloys are given in Table III, including the stress-rupture lives of conventionally annealed material, i.e., annealed at 2150° F. (1177° C.) for 3 to 15 minutes

TABLE III

| Alloy | Condition | Stress Rupture at 1700° F. (927° C.) and 11 ksi (75.85 MPa) in Hours |
|---|---|---|
| A | 1 | 14.1 |
| A | 2 | 10.9 |
| A | 3 | 11.7 |
| A | 4 | 13.2 |
| A | 5 | 25.0 |
| A | 6 | 11.9 |
| A | 7 | 12.2 |
| A | 8 | 11.0 |
| A | 9 | 10.9 |
| A | 10 | 3.0 |
| A | 11 | 40.5 |
| A | 12 | 36.3 |
| A | 13 | 17.1* |
| B | 1 | 91.6 |
| B | 2 | 14.2 |
| C | 1 | 2.0 |
| C | 2 | 1.5 |
| C | 3 | 12.2 |
| C | 4 | 20.0 |
| D | 1 | 15.0* |
| D | 2 | 14.5* |
| D | 3 | 20.6* |
| D | 4 | 21.4* |
| D | 5 | 21.1* |
| D | 6 | 26.6* |
| D | 7 | 26.2* |
| D | 8 | 21.8* |
| D | 9 | 8.2* |
| E | 1 | 32.0 |

*Stress rupture tested at 1600° F. (811° C.) and 14,300 psi (98.60 MPa)

A study of Table III reflects that when the more conventional annealing temperature of 2150° F. (1177° C.) was employed, Tests A-1, A-6 and A-7, a low stress-rupture life was the result, i.e., stress-rupture lives of less than 20 hours. Increasing the annealing temperature to 220° F. (1204° C.) and holding for 1 minute did not result in an improvement. Conditions A-8 and A-9. The same pattern followed with Alloys B and C annealed at 2150° F. (1177° C.) for 5 minutes, rupture life being 14.2 and 12.2 hours, respectively. Annealing at 2200° F. (1204° C.) for Alloy C and holding for 1 minute did result in an improvement to just 20 hours. Examination of Alloys B and C given the conventional anneal and using solvent extraction of the precipitates and X-ray diffraction showed that these alloys contained $M_{23}C_6$ carbides with an absence of $M_6C$. Some TiN was also found. The weight percent of the $M_{23}C_6$ carbide was approximately 0.1%.

Further attempts (A-2, A-3 and A-4) to increase the stress-rupture life of Alloy A by further heat treatment subsequent to the conventional anneal were to little avail. A-2 and A-3 sought to increase strength by increasing the amount of carbide precipitation whereas A-4 involved forming gamma prime as well as increasing carbide precipitation.

In marked contrast Alloys A, B and C when cold rolled and thermally processed in accordance with the invention manifested stress-rupture strength above the 20-hour level at 1700° F. (927° C.)/11,000 psi (75.85 MPa) as is evident from A-5, A-11, A-12 and B-1 of Table III. Examination showed that the $M_6C$ carbides constituted 80–85% of the carbides with the balance being $M_{23}C_6$ carbides which were mostly in the grain boundaries but in a more continuous film. A small amount of TiN was also observed in the grain boundaries. For A-11 and A-12 the weight percent of $M_6C$ was 1.6 and 1.82%, respectively. Alloy B upon annealing at 2050° F. (1121° C.) had a rupture life of 91.6 hours. It is thought that this might be an anomalous result, i.e., it may be somewhat high. Though Alloys D and E were tested at 1600° F. (871° C.) but at a higher stress (14,000 psi vs. 11,000 psi), it is considered that similar results would follow.

As evident from Alloy A-10, annealing within the 1850°–2050° F. temperature range does not always ensure the desired microstructure. If the degree of cold work is too extensive for a selected annealing condition (temperature, time and thickness) the carbide will not form or will dissolve. If A-10 was cold rolled 15 to 20% rather than the 51.7%, then recrystallization with concomitant $M_6C$ precipitation would have occurred as is evidenced by A-11 and A-12. Too, if the annealing period is insufficient for recrystallization to occur, then the grain size will be too small, i.e., say, ASTM #6 or finer, or there will be a mixture of cold worked and recrystallized grains. This is what transpired in the case of Alloy C annealed at 1900° F./1 min. and 2000° F./1 min. as was metallurgically confirmed.

In Table IV data are presented for Alloys A-10, A-11, A-12 in terms of the amount of $M_6C$ and $M_{23}C_6$ carbides as well as average ASTM grain size.

TABLE IV

| Total Precipitate (%) | $M_6C$ (%) | $M_{23}C_6$ (%) | Grain Size (ASTM) | Stress Rupture Life 1700° F. (927° C.)/11 ksi (75.7 mPa) (Life in Hours) |
|---|---|---|---|---|
| A-10 - 40% CW - 1900° F. (1038° C.)/5 minutes | | | | |
| 3.13 | 2.07 | 1.06 | 3.5 | 0.3 |
| A-11 - 16.6% CW - 1900° F. (1038° C.)/1 minute | | | | |
| 1.6 | 1.37 | 0.23 | 3.5 | 40.5 |
| A-12 - 16.6% CW - 2000° F. (1038° C.)/1 minute | | | | |
| 1.82 | 1.46 | 0.36 | 3.5 | 36.3 |

In Table V are representative tensile properties of Alloys A, B and E in given conditions set forth in Table II. Alloys within the invention should possess a minimum yield strength of 45,000 psi and preferably at least 50,000 psi at room temperature.

TABLE V

| Code | 0.2% Y.S. ksi | 0.2% Y.S. MPa | U.T.S. ksi | U.T.S. MPa | Elong., % |
|---|---|---|---|---|---|
| B-2 | 47.5 | 327.5 | 112.1 | 772.9 | 56 |
| B-1 | 45.4 | 313.0 | 107.5 | 741.2 | 64 |
| B-1 | 53.6 | 369.6 | 112.2 | 773.6 | 56 |
| A-5 | 57.4 | 395.8 | 109.5 | 775.0 | 52 |
| E-1 | 61.6 | 424.7 | 114.2 | 787.4 | 53 |

Alloys of the subject invention, in addition to combustor cans are deemed useful as fuel injectors and exhaust ducting, particularly for applications above 1800° F. (982° C.) and upwards of 2000° F. (1093° C.). For applications over the range of 1200°-1500° F. (649°-816° C.) the alloys are useful as shrouds, seal rings and shafting.

As contemplated herein, the term "balance" or "balance essentially" as used herein in reference to the nickel content does not exclude the presence of other elements which do not adversely affect the basic characteristics of the alloy. This includes oxidizing and cleansing elements in small amounts. For example, magnesium or calcium can be used as a deoxidant. It does not exceed (retained) 0.2%. Elements such as sulfur and phosphorus should be held to as low percentages as possible, say, 0.015% max. sulfur and 0.03% max. phosphorus. While copper can be present it is preferable that it not exceed 1%. The presence of iron should not exceed 5%, preferably not more than 2%, in an effort to achieve maximum stress rupture temperatures, particularly at circa 2000° F. (1093° C.). Tungsten may be present up to 5%, say 1 to 4%, but it does add to density. Columbium while it can be present tends to detract from cyclic oxidation resistance which is largely conferred by the co-presence of chromium and aluminum. Zirconium can beneficially be present up to 0.15 or 0.25%. Rare earth elements up to 0.15% e.g., one or both of cerium and lanthanum, also may be present to aid oxidation resistance at the higher temperatures, e.g., 2000° F. (1093° C.). Up to 0.05 or 0.1% nitrogen can be present. The alloy range of one constituent of the alloy contemplated herein can be used with the alloy ranges of the other constituents.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

The embodiments of the invention in which an exclusive property or privilege is claimed are defined as follows:

1. A nickel-chromium-molybdenum alloy characterized by a stress-rupture life exceeding 20 hours at a stress of 11,000 psi (75.85 MPa) and 1700° F. (927° C.), said alloy consisting essentially of about 15 to 30% chromium, about 6 to 12% molybdenum, about 5 to 20% cobalt, about 0.5 to 1.5% aluminum, up to about 0.75% titanium, about 0.04 to 0.15% carbon, up to 0.02% boron, up to 0.5% zirconium, up to 5% tungsten, up to 5% iron, up to about 0.2% rare earth metal, and the balance nickel, said alloy being further characterized by a substantially recrystallized microstructure comprised of at least 1 to 2% by alloy weight of $M_6C$ carbides and a lesser percentage of $M_{23}C_6$ carbides, with $M_6C$ carbide constituting at least 50% by weight of the carbides present, and with the grains being an average of about ASTM #3 to ASTM #5.

2. The alloy set forth in claim 1 in which the $M_6C$ carbides are not greater than about 3 microns in diameter.

3. The alloy set forth in claim 1 in which the TiN phase is present in an amount not above about 0.05%.

4. The alloy set forth in claim 1 in which the gamma prime phase is present up to about 5%.

5. The alloy set forth in claim 1 in which the $M_6C$ carbide constitutes at least 70% of the carbides.

6. The alloy set forth in claim 1 which contains about 19 to 25% chromium, about 7 to 11% molybdenum, about 7.5 to 15% cobalt, about 0.8 to 1.2% aluminum, up to about 0.6% titanium, about 0.06 to 0.12% carbon, up to 0.01% boron and up to about 0.25% zirconium.

7. A process for enhancing the stress-rupture strength of the alloy set forth in claim 1 such that it is characterized by a life in excess of 20 hours under a stress of 11,000 psi and a temperature of 1700° F. (927° C.), said process being comprised of a combination of cold rolling and thermal treatment in which the alloy is first cold reduced from 10% up to less than 60% and thereafter annealed at a temperature of 1850° to 2125° F. (1010°-1163° C.) for a period to provide a substantially recrystallized microstructure with an average grain size of about ASTM #3 to ASTM #5, and such that $M_6C$ carbide is formed and constitutes at least 1% by weight of the alloy.

8. The process set forth in claim 7 in which the cold reduction is from 15 to 40%.

9. The process set forth in claim 8 in which the annealing treatment is from about 1875° to 2025° F. (1024° to 1107° C.).

10. The process set forth in claim 7 in which the cold reduction is from 15 to 30%.

11. The process set forth in claim 10 in which the annealing treatment is from about 1900° to 2000° F. (1038° to 1093° C.).

12. A nickel-chromium-molybdenum alloy characterized by a stress-rupture life exceeding 20 hours at a stress of 11,000 psi (75.85 MPa) and 1700° F. (927° C.), said alloy consisting essentially of about 15 to 30% chromium, about 6 to 12% molybdenum, about 5 to 20% cobalt, about 0.5 to 3% aluminum, up to about 5% titanium, about 0.04 to 0.15% carbon, up to 0.02% boron, up to 0.5% zirconium, up to 5% tungsten, up to 5% iron, up to about 0.2% rare earth metal, and the balance nickel, said alloy being further characterized by a substantially recrystallized microstructure comprised of at least 1 to 2% by alloy weight of $M_6C$ carbides and a lesser percentage of $M_{23}C_6$ carbides, with $M_6C$ carbide constituting at least 50% by weight of the carbides present, and with the grains being an average of about ASTM #3 to ASTM #5.

13. The alloy set forth in claim 12 in which the $M_6C$ carbides are not greater than about 3 microns in diameter.

14. The alloy set forth in claim 12 and containing up to about 0.1% nitrogen.

15. The alloy set forth in claim 12 in which the TiN phase is present in an amount not above about 0.05%.

16. The alloy set forth in claim 12 in which the $M_6C$ carbide constitutes at least 70% of the carbides present.

* * * * *